US007667129B2

(12) United States Patent
Chidlaw et al.

(10) Patent No.: US 7,667,129 B2
(45) Date of Patent: Feb. 23, 2010

(54) CONTROLLING AUDIO EFFECTS

(75) Inventors: Robert H. Chidlaw, Westford, MA (US); Jesse M. Remignanti, Arlington, MA (US)

(73) Assignee: Source Audio LLC, Woburn, MA (US)

( * ) Notice: Subject to any disclaimer, the term of this patent is extended or adjusted under 35 U.S.C. 154(b) by 0 days.

(21) Appl. No.: 11/709,953

(22) Filed: Feb. 23, 2007

(65) Prior Publication Data

US 2007/0169615 A1 Jul. 26, 2007

Related U.S. Application Data

(63) Continuation-in-part of application No. 11/145,872, filed on Jun. 6, 2005.

(60) Provisional application No. 60/776,638, filed on Feb. 24, 2006.

(30) Foreign Application Priority Data

Jun. 6, 2006 (WO) ..... PCT/US2006/021952

(51) Int. Cl.
*G10H 3/00* (2006.01)

(52) U.S. Cl. ..... 84/723; 84/725; 84/726; 84/730; 84/731; 84/735; 84/736; 84/737

(58) Field of Classification Search ..... None
See application file for complete search history.

(56) References Cited

U.S. PATENT DOCUMENTS

| | | | | |
|---|---|---|---|---|
| 5,147,969 | A * | 9/1992 | Hiyoshi et al. | 84/600 |
| 5,449,858 | A * | 9/1995 | Menning et al. | 84/727 |
| 6,150,947 | A | 11/2000 | Shima | 340/692 |
| 6,861,582 | B2 * | 3/2005 | Street | 84/600 |
| 6,995,310 | B1 | 2/2006 | Knapp et al. | 84/722 |
| 2003/0041721 | A1 * | 3/2003 | Nishitani et al. | 84/609 |
| 2003/0101863 | A1 * | 6/2003 | Street | 84/723 |
| 2003/0196542 | A1 * | 10/2003 | Harrison, Jr. | 84/737 |
| 2004/0200338 | A1 | 10/2004 | Pangrle | 84/724 |
| 2005/0109197 | A1 | 5/2005 | Garrett et al. | 84/726 |
| 2006/0060068 | A1 | 3/2006 | Hwang et al. | 84/615 |
| 2006/0107822 | A1 | 5/2006 | Bowen | 84/612 |
| 2006/0243123 | A1 * | 11/2006 | Ierymenko | 84/742 |
| 2006/0272489 | A1 * | 12/2006 | Remignanti | 84/723 |

* cited by examiner

*Primary Examiner*—Marlon T Fletcher
(74) *Attorney, Agent, or Firm*—Chapin IP Law, LLC; Barry W. Chapin, Esq.

(57) ABSTRACT

An audio effects control for and method of controlling the application of special audio effects applied to an audio signal, comprises a sensor configured to sense movement associated with the generation of the audio signal, wherein the sensor produces a control signal in response to detecting the movement, and the control signal is transmitted to an audio effects unit to control application of an audio effect on an audio signal.

28 Claims, 7 Drawing Sheets

CONTROLLING AUDIO EFFECTS

RELATED APPLICATIONS

This application is a continuation in part and claims priority to earlier filed U.S. patent application Ser. No. 11/145,872 entitled "Method of and System for Controlling Audio Effects,", filed on Jun. 6, 2005, the entire teachings of which are incorporated herein by this reference.

This application claims priority to earlier filed PCT patent application Ser. No. PCT/US2006/021952 entitled "Method of and System for Controlling Audio Effects,", filed on Jun. 6, 2005, the entire teachings of which are incorporated herein by this reference.

This application is related to and claims the benefit of earlier filed U.S. Provisional Patent Application Ser. No. 60/776,638 entitled "Method of and System for Controlling Outputs,", filed on Feb. 24, 2006, the entire teachings of which are incorporated herein by this reference.

TECHNICAL FIELD

This disclosure relates to applying special audio effects to sounds produced, for example, by musical instruments and, more particularly, to controlling the application of such audio effects.

BACKGROUND

As a musician or performer plays an instrument during a concert or other type of performance, a song may call for or it may be desirable to apply one or more special audio effects to musical notes produced by the instrument. To apply the effect, audio signals from the instrument are sensed (e.g., with a microphone, pickup, etc.) and sent to a signal processor that may be dedicated to applying such effects to the audio signals. After the one or more audio effects are applied by the signal processor, the processed audio signals are usually conditioned (e.g., amplified, filtered, etc.) and provided to speakers or other type of output device. To initiate the application of the audio effects, the person (playing the instrument) typically steps on a foot-pedal that is located on stage near the person. However, to trigger the application of the audio effects on stage, the musician must first locate the foot-pedal and then step on the pedal in a manner as to not look awkward or out of step with the song being played.

SUMMARY OF THE DISCLOSURE

In accordance with an aspect of the disclosure, an audio effects control is configured to include a sensor that senses movement, for example, a change in position, orientation, acceleration or velocity of the sensor. For example, by mounting the sensor to a musical instrument, the movement may be the sensed movement associated with playing a musical instrument. Alternatively, by securing the sensor to the person playing the instrument the sensor will sense movement of part of the person to which the sensor is secured. The sensor produces an electrical signal in response to detecting the movement, or change in position or orientation, and the electrical signal is sent to an audio effects unit to control application of one or more audio effects on audio signals produced by the musical instrument. The sensor can be secured to any other item for which movement or position or orientation of the sensor can be initiated and/or controlled.

The sensor may be configured to sense any one or several phenomena. For example, the sensor may be configured to sense acceleration of the musical instrument (with the aid, for example, of an accelerometer), velocity, or alternatively a position change of the musical instrument (with the aid, for example, of a gyroscope). The position change sensed by the sensor may include any movement, or a prescribed movement such as the musical instrument or a portion of the instrument rotating about an axis or translating along an axis.

Various types of electrical signals may be produced by the sensor. For example, the electrical signal may be an analog signal and may be modulated for transmission from the sensor. An electrical circuit may also be provided for conditioning the electrical signal. The audio effects control also includes an audio effects unit which is responsive to the signal generated by the sensor. The electrical circuit may convert the electrical signal into a digital signal prior to transmission to the audio effects unit. The electrical circuit may also convert the electrical signal into a musical instrument digital interface (MIDI) signal.

In various embodiments, sensing movement may include sensing acceleration of a portion of the musical instrument, sensing acceleration of a portion of a person playing the musical instrument, sensing a rotation of a portion of the musical instrument and/or sensing a rotation of a portion of a person playing the musical instrument, or sensing a translation of a portion of the musical instrument and/or sensing a translation of a portion of a person playing the musical instrument.

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

DETAILED DESCRIPTION OF THE EMBODIMENTS

Figure 1:
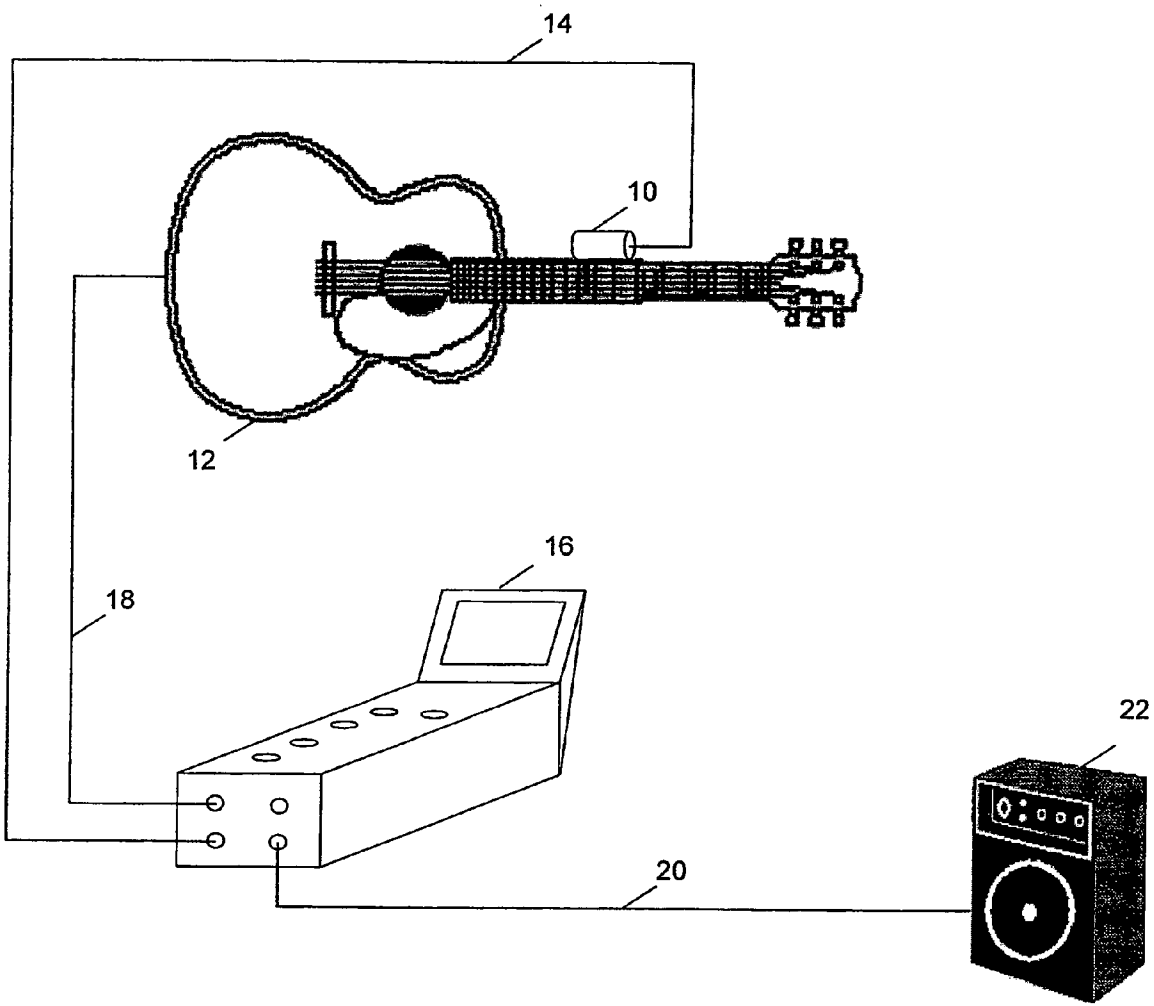
FIG. 1 is a diagrammatic view of one embodiment of an audio signal processing system that includes an instrument-mounted sensor that controls the application of audio effects to audio signals produced by a musical instrument.

Referring to FIG. 1, one embodiment of the disclosed system includes a sensor 10 mounted to a guitar 12 so that the sensor is capable of sensing movements, or alternatively the position, change in position, orientation, and/or change in orientation of the guitar. Based on the sensed movement or position or orientation of the guitar, and specifically sensor 10, a signal is produced by sensor 10 and provided over a cable or wires 14 to an audio effects unit 16. Along with the signals from sensor 10, audio effects unit 16 also receives audio signals that are produced by guitar 12, and provided, for example, over a cable or wires 18 to audio effects unit 16. Various types and combinations of audio effects may be applied by audio effects unit 16 to the audio signals produced by guitar 12. For example, the audio signals may be amplified, attenuated, distorted, reverberated, time-delayed, up or down mixed into other frequency bands, or applied with other similar effects known to one skilled in the art of conditioning audio signals so as to produced audio effects. Also, while guitar 12 is shown for producing audio signals, sensor 10 may be mounted to one or a combination of other types of musical instruments. For example, other types of string instruments (e.g., bass guitar, cello, violin, viola, etc.), brass instruments (e.g. trumpets, saxophones, etc.), woodwind instruments (e.g., clarinets, etc.), percussion instruments, keyboard instruments, or other types of instruments or collections of instruments may be used to produce audible signals. Further, the term musical instrument also includes devices that sense vocal signals. For example, sensor 10 may be mounted onto a microphone so as to sense the movement, orientation or position of the microphone. By detecting the movement, position or orientation of the microphone, a signal produced by sensor 10 may be used to control the application of audio effects to the audio signals (e.g., vocal signals) received by the microphone.

When playing the instrument, a musician may intentionally move guitar 12 in a particular manner such that sensor 10 senses the movement and sends a control signal over cable 14 to audio effects unit 16. Upon receiving the control signal, one or more predefined special audio effects are applied in a controlled manner to the audio signals that are provided over cable 18 from guitar 12. The control signal from sensor 10 may provide various types of control to the application of the audio effects. For example, the control signal may initiate the application of one or more audio effects. By providing this trigger from the control signal, the musician is free to apply an effect from any location rather than e.g., having to seek out and step on a foot-pedal. Other types of audio effect control may be provided by the control signal. For example, rather than providing a discrete trigger signal to initiate (or halt) application of one or more effects, a variable control signal (analog or digital) may be produced by sensor 10. The variable signal may be used to dynamically control various aspects of the audio effects. For example, the variable control signal may be used to adjust the resonant frequency of an audio effect or other similar parameter.

In this illustrative example, after the audio effects are applied, the audio signals are sent over a cable 20 to an amplifier/speaker 22 that broadcasts the signals. As suggested, to halt the application of the audio effects, in some arrangements the musician may intentionally move guitar 12 in another manner such that the movement is detected by the sensor 10. Based on the detected movement, another trigger signal is sent over cable 14 to audio effects unit 16. Upon receiving this second trigger signal, application of the audio effects may be halted or different audio effects may be applied. Alternatively, the audio effects may last a predetermined time period before ending. In another arrangement the audio effects may continue until a cue is provided from the music, e.g., there is a pause or halt in the music, or a particular note is played. In addition, one or more of the audio effects applied to the music can be applied in a fade in and/or fade out fashion.

Figure 2:
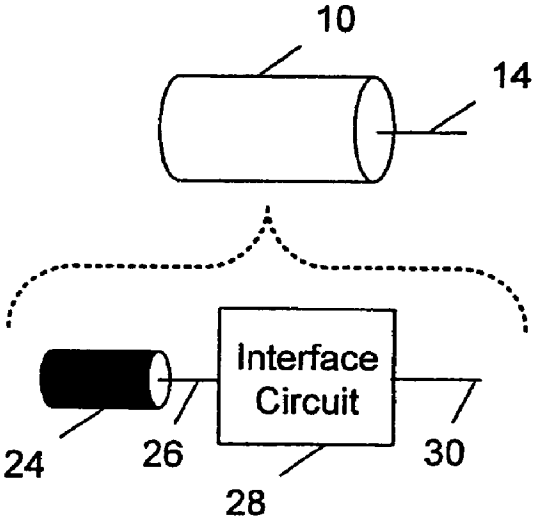
FIG. 2 is a diagrammatic view of the sensor shown in FIG. 1.

Referring to FIG. 2, the contents of sensor 10 includes a sensing device 24 that senses the movement of the sensor (and correspondingly the movement of guitar 12). Various sensing techniques known to one skilled in the art of transducers may be implemented in sensing device 24. In one example, sensing device 24 may include an accelerometer that senses acceleration (i.e., rate of change of velocity with respect to time) in one or more directions, and produces an electrical signal as a function of the sensed acceleration. Alternatively or in addition, one or more gyroscopes may also be included in sensing device 24. By including an inertial device such as a gyroscope, a change in attitude (e.g., pitch rate, roll rate, and yaw rate) of sensor 10 may be detected and an electrical signal produced as a function of the sensed attitude change. Other types of sensors that detect change in position, change in velocity, or change in acceleration may be included in sensing device 24. For example, a pressure sensor (e.g., piezoelectric sensor, ceramic sensor, etc.) mounted on guitar 12 or incorporated into a pick used to play guitar 12 may be used as a sensing device. Sensor 10 may also include multiple sensing devices. For example, one sensing device may be dedicated for detecting motion along one axis and another sensing device may be dedicated for detecting motion along a second axis of rotation.

As illustrated in FIG. 2, sensing device 24 is preferably connected (via a conductor 26) to an interface circuit 28 that prepares the electrical signal produced by the sensing device for transmission. For example, interface circuit 28 may include circuitry for filtering, amplifying, or performing other similar functions on the electrical signal provided over conductor 26. In this example, once the electrical signal is conditioned for transmission, a conductor 30 provides the conditioned signal to cable 14 for delivery to audio effects unit 16. Besides using hard-wire connections to provide the signal to audio effects unit 16, other signal transmission techniques known to one of skill in the art of electronics and telecommunications may be implemented. For example, interface circuit 28 may include wireless technology such as a wireless transmitter or transceiver for transmitting the signals produced by sensing device 24 over a wireless link. Various types of wireless technology, such as radio frequency (RF), infrared (IR), etc., may be implemented in interface circuit 28 and the audio effects unit 16. Furthermore, in some arrangements a combination of hard-wire and wireless technology may be implemented in interface circuit 28 and audio effects unit 16. Interface circuit 28 may also include circuitry configured and arranged so as to transfer the signals into another domain. For example, an analog signal produced by sensing device 24 may be converted into a digital signal by an analog-to-digital converter included in interface circuit 28. Modulation techniques may also be provided by interface circuit 28. For example, the signals produced by the sensing device 24 may be amplitude, phase, frequency, and/or polarization modulated in the analog or digital domain. In one particular example, the signals produced by interface circuit 28 are pulse-width modulated. Interface circuit 28 may encode the signals that are transmitted to audio effects unit 16. For example, the signals may be encoded to comply with particular formats such as the musical instrument digital interface (MIDI) format. In one implementation, movement sensed by sensing device 24 may be translated into MIDI control signals for bending pitch or modulating the audio signal from the instrument. By producing these control signals from the sensing device, e.g., effects are controlled through the movement of sensing device 24 rather than using the common pitch bend and modulation knobs on a synthesizer.

Figure 3:
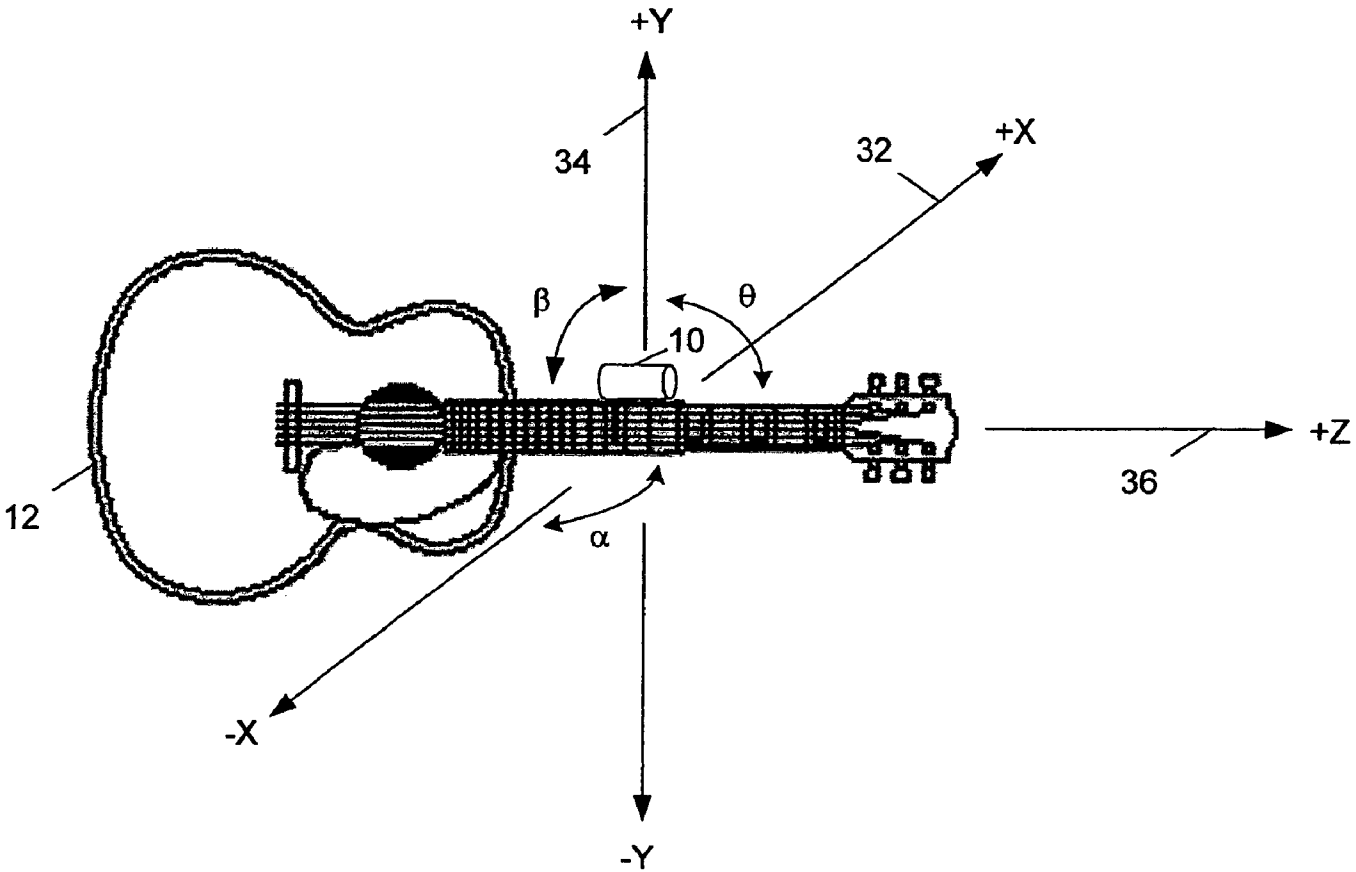
FIG. 3 illustrates possible detectable movements of the instrument shown in FIG. 1.

Referring to FIG. 3, one set of potential movements of guitar 12 that might be sensed by sensor 10 and initiate signal generation by the sensor are illustrated as an example of how the system operates. To assist the illustration, three axes 32, 34, and 36 are shown in a right-handed rectangular coordinate system. In this example, sensor 10 is capable of sensing rotation of guitar 12 about any one of axes 32, 34, or 36. For example, if guitar 12 is "pitched" about axis 32 (as represented by angle □) a signal is produced by sensor 10 and is transmitted to audio effects unit 16. Guitar 12 may also be "rolled" about axis 36 (as represented by angle □) or "yawed" about axis 34 (as represented by angle □) and a signal is produced by sensor 10.

Along with detecting the rotation of guitar 12, other movements may be sensed and initiate generation of an electrical signal by sensor 10. For example, sensor 10 may include a gyroscope or other device for sensing the orientation of the sensor, or the sensor 10 may be capable of sensing translation of the guitar. By incorporating a global positioning system (GPS) receiver in sensor 10, for example, a signal may be produced as the position of the guitar changes as the musician moves. A laser system may also be incorporated into sensor 10 to sense position changes of the guitar relative to one or more reflective surfaces (e.g., a polished floor, wall, ceiling, etc.).

By sensing these rotational, orientation and/or translational changes, the signals produced by sensor 10 may be used by audio effects unit 16 to control the application of one or more audio effects to the musical tones produced by guitar 12. For example, the performer may intentionally move the guitar to apply an audio effect known as a "wah-wah" effect. This type of effect is generated by sweeping the resonant frequency of a filter (which may be included in audio effects unit 16). As guitar 12 changes position, the corresponding signals produced by sensor 10 controls the application of the audio effect. For example, guitar 12 may initially be oriented downward (in the "y" direction) along axis 34 and the signal produced by sensor 10 controls the application of the audio effect at to the low resonant frequency (e.g., 200 Hz) of the filter. As guitar 12 is rotated toward an upward vertical position (oriented in the "+y" direction) along axis 34, the signals produced by sensor 10 controls the application of the audio effect across the frequency spectrum of the filter to an upper resonant frequency (e.g., 4000 Hz). This "wah-wah" effect (or another effect) may also be applied as guitar 12 is rotated about any of the axes (e.g. axis 32, 34, or 36) shown in the figure. Also, sensor 10 may control the application of this effect as guitar 12 is translated (e.g., carried by the performer across a stage), or the orientation of the guitar is changed, or otherwise moved so that the sensor responds.

Figure 4:
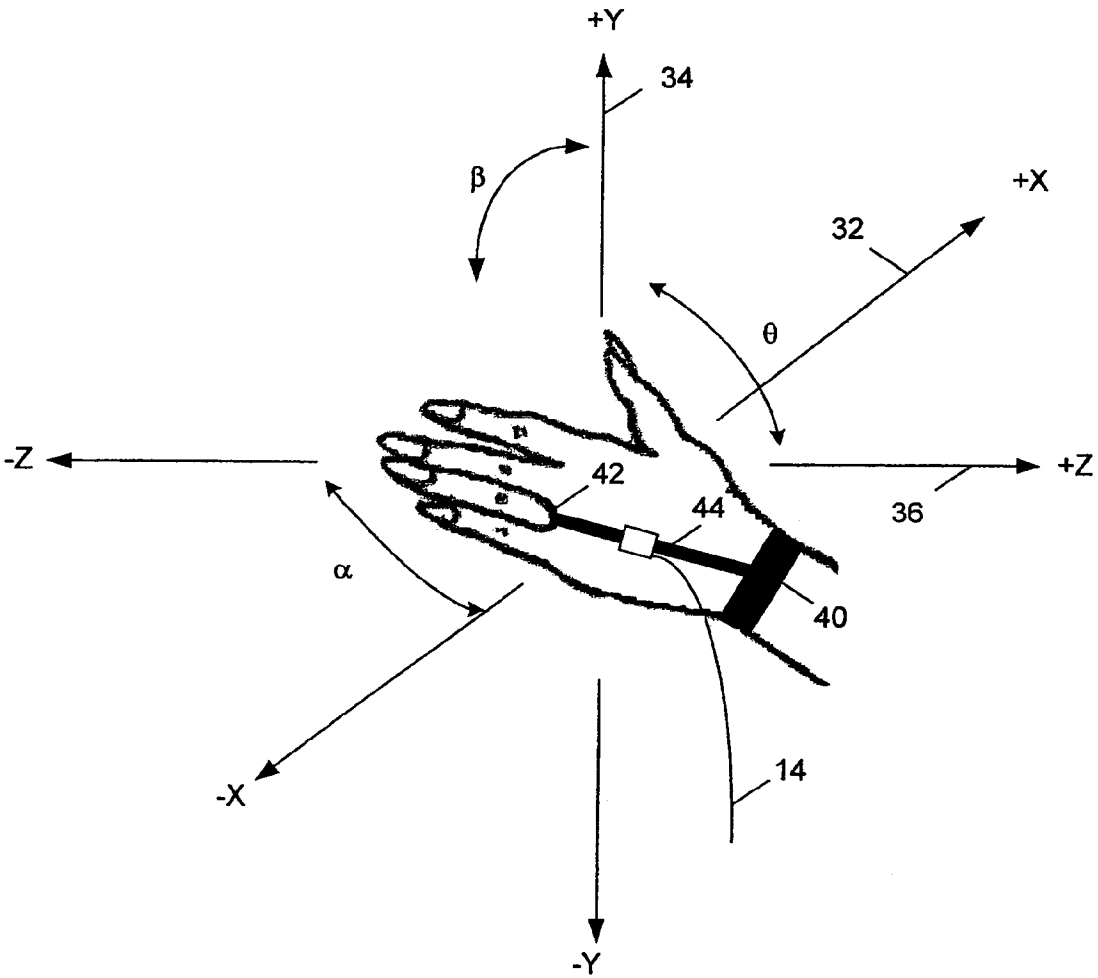
FIG. 4 is a diagrammatic view of one embodiment of a sensor designed and configured to be hand-mounted so as to control the application of audio effects to audio signals produced by a musical instrument with movement of the hand.

Along with or in lieu of attaching sensor 10 to the instrument (e.g. guitar 10), one or more sensors may also be attached to the performer playing the instrument. An example is shown in FIG. 4. In this arrangement, sensor 10 is attached to the back of the performer's hand 38. To hold sensor 10 in place and not interfere with the musician's playing of guitar 12, a wrist strap 40 and a figure loop 42 provide tie points to the musician's hand 38. Sensor 10 is attached to a strap 44 that is respectively connected between wrist strap 40 and figure loop 42. Various types of material may be used to produce wrist strap 40, figure loop 42, and strap 44. For example, flexible material such as neoprene or nylon may be used for hold sensor 10. Other types of attachment mechanisms known to one skilled in the art of clothing design or clothing accessories may be implemented to secure sensor 10 to the musician.

While sensor 10 is attached to the performer in the illustrated FIG. 4, and not the instrument, the sensor functions in a similar manner. In the example shown in FIG. 4, changes in position, velocity, acceleration, and/or orientation of the musician's hand may be detected and used to produce a control signal. The signal may be used to control the application of audio effects by audio effects unit 16. Similar to detecting movements of an instrument, with sensor 10 attached to the musician's hand, various hand movements may be detected. For example, a control signal may be produced if the performer rotates his or her hand about axis 32 (as represented by angle □), or about axis 34 (as represented by angle □), or about axis 36 (as represented by angle □).

By attaching sensor 10 to the performer, movement may be better controlled. For example, the performer may trigger a "wah-wah" audio effect by pointing his or her hand toward the ground (along the "−y" direction of axis 34) to apply of the audio effect at the low resonant frequency (e.g., 200 Hz) of a filter. Then, the performer may rotate his or her arm about axis 32 and point their hand toward the ceiling (along the "+y" direction of axis 34). While making this motion, signals produced by sensor 10 may control the application of the audio effect across the frequency spectrum of the filter to the upper resonant frequency (e.g., 4000 Hz). Other types of audio effects may also be controlled based on the motion of the musician's hand.

In the illustrated example of FIG. 4, the signals generated by sensor 10 are provided to audio effects unit 16 over cable 14. However, wireless circuitry (e.g., RF, IR, etc.) may be implemented into sensor 10 to remove the need for cable 14 and increase the mobility of the performer as he or she plays guitar 12 (or another instrument). Accordingly, a user wearing the sensor 10 need not be tethered by a cable 14 to an audio effects unit.

While this example described attaching sensor 10 to the musician's hand, in other arrangements, the sensor may be attached elsewhere to the musician. For example, sensor 10 may be incorporated into an arm-band or attached to a piece of the musician's clothing or costume. Additionally, multiple sensors may be attached to the musician for producing multiple signals that may be used to control the application of one or more audio effects by audio effects unit 16. By incorporating one or more of these sensors onto the performer or onto the instrument played by the performer, musical performances are improved since the performer is free to move anywhere on stage and trigger the application of audio effects.

A number of implementations have been described. Nevertheless, it will be understood that various modifications may be made. For example, prescribed movements of the sensor are described as producing the control signal for producing the audio effect. It is also possible to have multiple sensors for producing different audio effects. A system can also be provided wherein different prescribed movements of a sensor can produce different audio effects. Further, while audio effect unit 16 is shown as a standalone unit, it may be connected to a computerized system, or alternatively be embodied as a software program run entirely on a computerized system. As such the signals generated by the sensor or sensors would be received by the computerized system and processed by the system before the signals are generated so as to drive one or more loudspeakers, such as speaker 22 in the illustrated embodiment shown in FIG. 1. Accordingly, other implementations are within the scope of the following claims.

Figure 5:
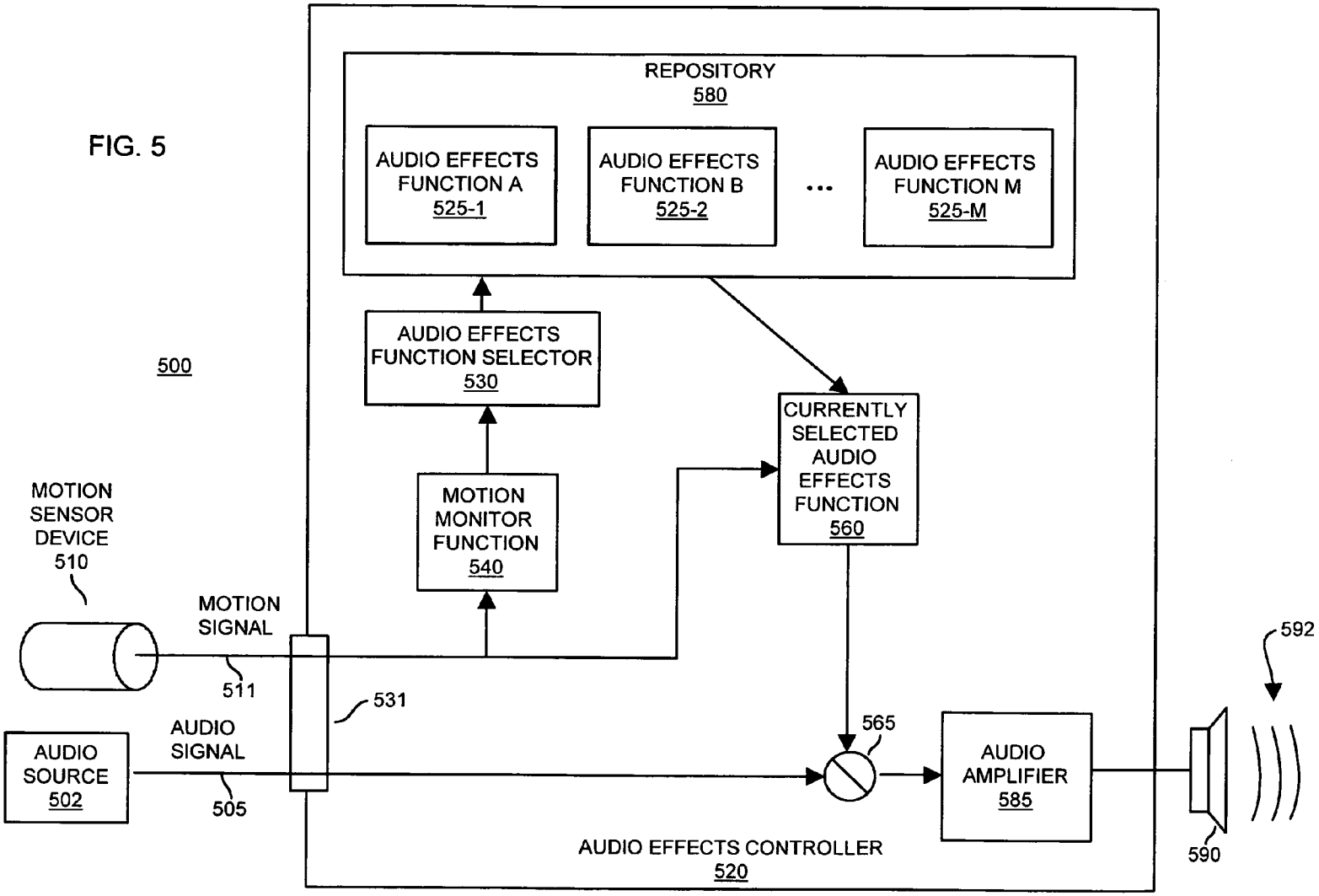
FIG. 5 is a diagram illustrating an example audio effects system according to embodiments herein.

FIG. 5 is a diagram of an audio system illustrating use of a motion sensor device 510 to apply different audio effects to a corresponding received audio signal 505 according to embodiments herein. As shown, audio effects controller 520 receives audio input signal 505 (e.g., an electronic audio signal) produced by audio source 502. Audio source 502 can be any type of device that produces an audio signal such as a guitar, an MP3 player, a computer, live microphone, etc.

According to one operational mode as shown, audio effects controller 520 applies currently selected audio effects function 560 to the received signal 505 for amplification by audio amplifier 585 and playback on speaker 590 as an audible signal 592. As described herein, the application of audio effects (e.g., associated with currently selected audio effects function 560) to received audio signal 505 depends on motion associated with motion sensor device 510. For example, as the motion sensor device 510 produces a spectrum of motion signals 511, the audio effects controller 520 applies different audio effects to the audio signal as specified by the motion signal 511 and the currently selected audio effects function 560. Accordingly, a musician wearing the motion sensor device 510 on his hand and playing a corresponding guitar (e.g., audio source 502) that produces the audio signal 505 can apply audio effects to the audio signal produced by the guitar merely by movements associated with the motion sensor device 510.

Note that a current operational mode associated with audio effects controller 520 can be changed based on motion associated with the motion sensor device 510. For example, the audio effects controller 520 can support multiple different types of audio effects functions 525 (e.g., audio effects function 525-1, audio effects function 525-2, audio effects function 525-M) for selective application to the received audio signal 505. Motion monitor function 540 can provide continuous monitoring of motion signal 511 produced by motion sensor device 510. When motion monitor function 540 detects a predetermined type of input associated with the motion sensor device 510, the motion monitor function 540 can initiate a signal to audio effects function selector 530 to select a different type of audio effects function 525 for application to the received audio signal 505. As an example, in one embodiment, a user wearing motion sensor device 510 can knock (one or more times) on a substantially stationary object (e.g., side of a guitar, table, floor etc.) such that motion signal 511 indicates a sudden deceleration associated with the motion sensor device 510. In response to receiving such input (e.g., a motion signal 511 having a magnitude outside of a predetermined operating range or above a threshold value), the motion monitor function 540 provides a command to audio effects function selector 530 to select and download a corresponding audio effects function 525 from repository 580 to currently selected audio effects function 560 for application to the received audio signal 505.

In one embodiment, the number of knocks detected by the motion monitor function 540 indicates which of the audio effects function 525 to currently apply to the received audio signal 505. For example, the motion monitor function 540 can be configured to prompt application of audio effects function 525-1 in response to detecting two knocks, prompt application of audio effects function 525-2 in response to detecting three knocks, and so on.

Note that the audio effects controller 520 can also toggle between a first mode (e.g., which applies audio effects to the received audio signal 505) and a second mode (e.g., which prevents application of audio effects to the received audio signal 505) based on detection of motion signal 511 above a threshold value. Accordingly, a user can knock on an object to terminate application of an audio effects function to the received audio signal and knock again to turn on application of the audio effects function to the received audio signal 505. Embodiments herein therefore include detecting a change in motion associated with the motion sensor device 510; comparing the change in motion to a threshold value; and in response to detecting that the change in motion for a given time interval (e.g., sampling of motion signal 511 for a time duration) is greater than a threshold value, discontinuing application of the a currently selected audio effects to the received audio signal 505. Thus, embodiments herein include detecting that a user wearing the motion sensor device 510 knocks on an object to disable application of the audio effect to the received audio signal 505 as well as detecting that a user wearing the motion sensor device 510 knocks on an object to enable application of the audio effect to the received audio signal 505.

In other words, embodiments herein support detecting that a user wearing the motion sensor device 510 knocks on an object (e.g., the side of a guitar) to switch between a first mode of applying the audio effect (e.g., audio effects function) to the received audio signal and a second mode of terminating application of the audio effect (e.g., audio effects function) to the received audio signal 505.

Accordingly, motion sensor device 510 can produce dual control functionality. For example, one control function (e.g., when the motion sensor device 510 produces a voltage outside of a range or above a threshold value) indicates which of multiple audio effects modes to apply to audio signal 505. Another control function (e.g., when the motion sensor device 510 produces a voltage within a predefined range) indicates which of a corresponding spectrum of audio effects of a currently selected audio effects function 560 to apply to the received audio signal 510.

Application of different audio effects to the received audio signal 505 can include application of such functions as amplification, attenuation, distortion, reverberation, time delaying, up mixing, down mixing of the received audio signal into other frequency bands to modify the received audio signal 505 for playback on speaker 590.

Note further that the motion sensor device 510 can produce a signal for each of multiple axis of motion. In such an embodiment, the motion monitor function 540 can initiate selection of a new mode when either or both of the monitored axis produces a sudden deceleration above a threshold value based on corresponding movement associated with motion sensor device 510. Requiring detector of multiple "knocks" to change an audio effects mode associated with audio effects controller 520 can help prevent inadvertent mode changes when a respective user wearing the motion sensor device 510 accidentally bumps his hand (or other appendage as the case may be) into a stationary object and produces a false "change mode" signal.

Figure 6:
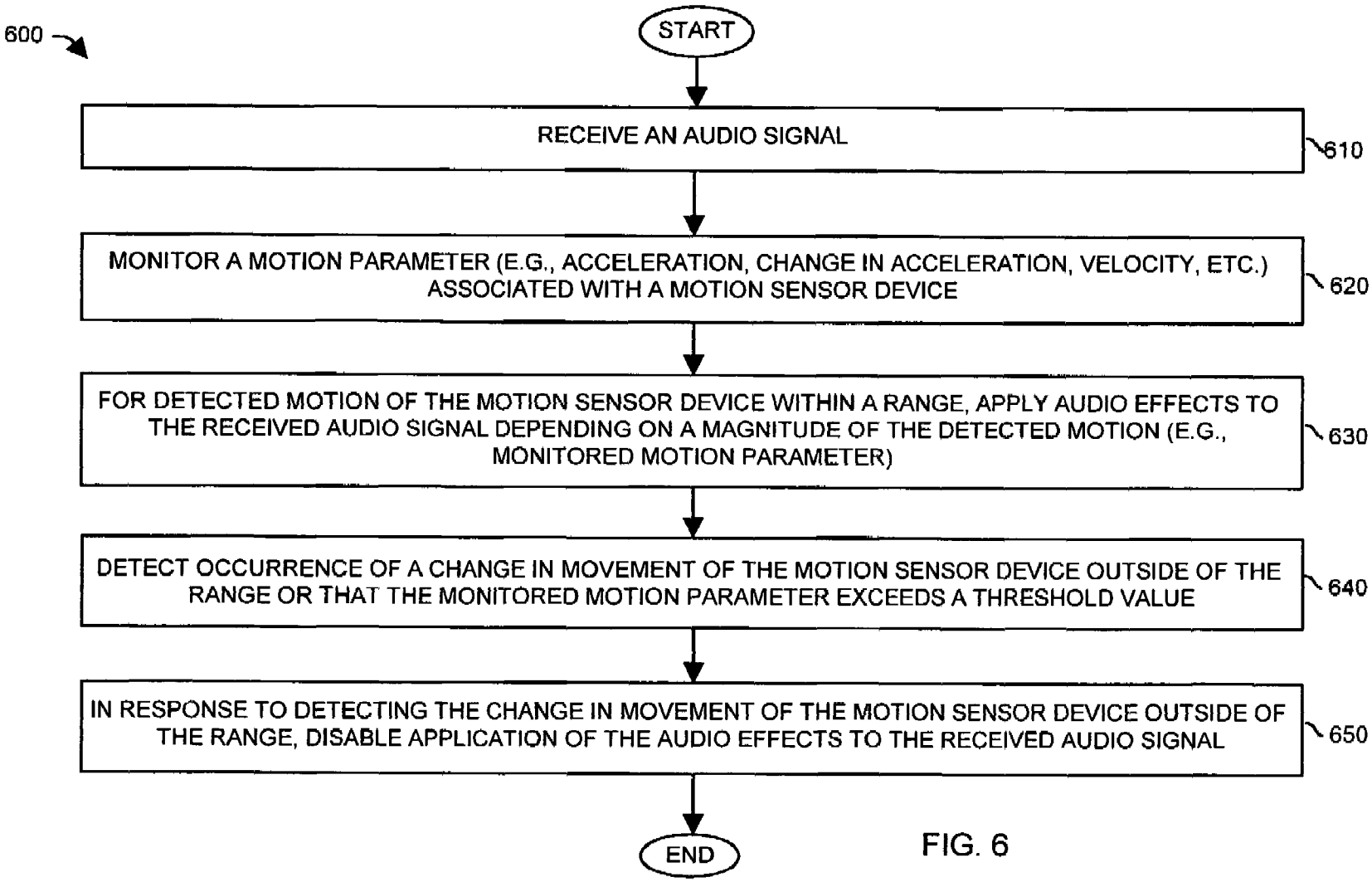
FIG. 6 is a diagram of an example flowchart according to embodiments herein.

FIG. 6 is a diagram of a flowchart 600 illustrating application of different audio effects to a received audio signal according to embodiments herein.

In step 610, the audio effects controller 580 receives an audio signal 505 from audio source 502 (e.g., a musical instrument such as a guitar, an audio playback device such as an MP3 player, etc.).

In step 620, the audio effects controller 580 monitors a motion parameter (e.g., acceleration, change in acceleration, velocity, etc.) associated with motion sensor device 510. As previously discussed, in one embodiment, a user wears the motion sensor device 510 while playing a musical instrument such as a guitar.

In step 630, for detected motion of the motion sensor device 510 within a predefined range, the audio effects controller 580 applies a currently selected audio effects function 560 to the received audio signal 505 depending on a magnitude of the detected motion (e.g., monitored motion parameter) monitored by motion monitor function 540.

In step 640, the audio effects controller 580 detects occurrence of a change in movement (e.g., monitored motion parameter such as acceleration) of the motion sensor device 510 outside of the range or that the monitored motion parameter exceeds a threshold value. For example, in one embodiment as previously discussed, the motion monitor function 540 detects a sudden deceleration of motion associated with the motion sensor device 510 (e.g., strapped to a user's hand) as a result of the user repeatedly knocking on a relatively stationary object such as a guitar. Occurrence of one or more knocks by the user can indicate to switch which of multiple audio effects functions 525 to apply to the received audio signal 505.

In one embodiment, occurrence of two knocks by the user can indicate to toggle between a first mode in which the audio effects controller 520 applies an audio effects function to the received audio signal and a second mode in which the audio effects controller 520 does not apply any audio effects functions to the received audio signal 505. Thus, a user can select the first mode (e.g., an ON mode) for modifying (e.g., distorting) the received audio signal 505 (according to a selected audio effects function) for playing on speaker 590. The user can select the second mode (e.g., an OFF mode) for merely playing the received audio signal 505 on speaker 592 without any modification (e.g., without any distortion or application of an audio effects function).

In step 650, in response to detecting the change in movement (e.g., a sudden deceleration as a result of knocking on an object) of the motion sensor device 510 outside of the range or that the motion sensor device 510 experiences a change in deceleration above a threshold value, the audio effects controller 580 discontinues application of the audio effects to the received audio signal 505.

Figure 7:
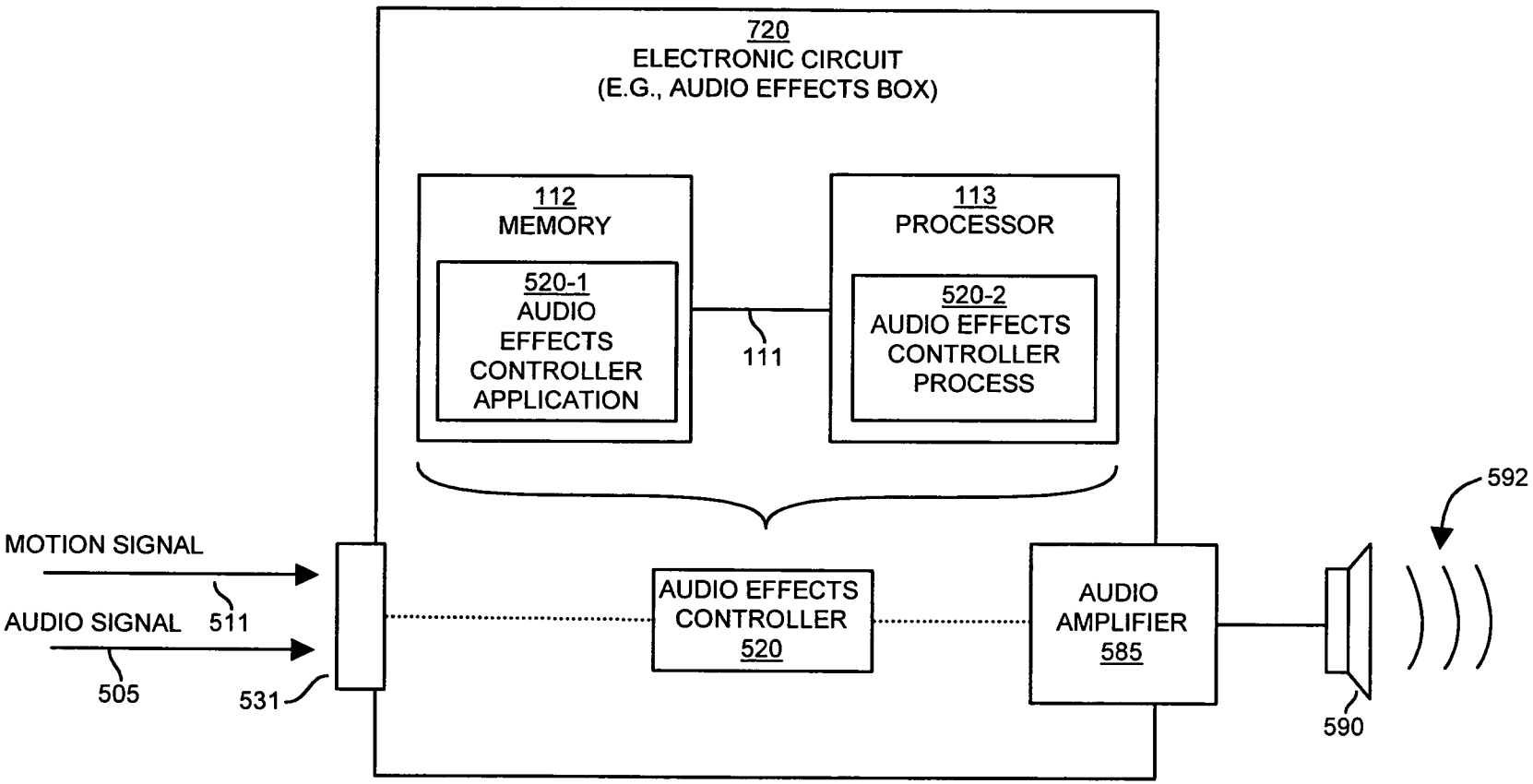
FIG. 7 is a diagram of an example architecture supporting application of audio effects to an audio signal according to embodiments herein.

FIG. 7 is a block diagram illustrating an example system (e.g., electronic circuit 720) for executing audio effects controller 520 (e.g., audio effects controller application 520-1 and audio effects controller 520-2) and/or other functions according to embodiments herein. The audio effects controller application 520-1 can support any of the functionality as described herein.

Audio effects controller 520 can be or include a computerized device such as a electronic processing circuitry, a microprocessor, a computer system, a digital signal processor, controller, personal computer, workstation, portable computing device, console, processing device, etc.

As shown, audio effects controller 520 of the present example includes an interconnect 111 that couples a memory system 112 and a processor 113. Interface 531 enables the audio effects controller 520 to receive motion signal 511 (as produced by a motion sensor device 510) and an audio signal 505. As previously discussed, audio effects controller 520 enables a respective user to apply audio effects based on a magnitude of detected motion as generated by the user.

As shown, memory system 112 is encoded with audio effects controller application 520-1 to perform the different functions as described herein. Functionality (such as the audio effects controller application 520-1) associated with the processor 720 can be embodied as software code such as data and/or logic instructions (e.g., code stored in the memory or on another computer readable medium such as a disk) that, when executed, support functionality according to different embodiments described herein.

During operation, processor 113 of electronic circuit 720 accesses memory system 112 via the interconnect 111 in order to launch, run, execute, interpret or otherwise perform the logic instructions of the audio effects controller application 520. Execution of audio effects controller application 520-1 produces processing functionality in audio effects controller process 520-2. In other words, the audio effects controller process 520-2 represents one or more portions of the audio effects controller application 520-1 (or the entire application) performing within or upon the processor 113 in the electronic circuit 720.

It should be noted that, in addition to the audio effects controller process 520-2, embodiments herein include the audio effects controller application 520-1 itself (i.e., the unexecuted or non-performing logic instructions and/or data). The audio effects controller application 520-1 can be stored on a computer readable medium such as a floppy disk, hard disk, or optical medium. The audio effects controller application 520-1 can also be stored in a memory type system such as in firmware, read only memory (ROM), or, as in this example, as executable code within the memory system 112 (e.g., within Random Access Memory or RAM).

In addition to these embodiments, it should also be noted that other embodiments herein include the execution of audio effects controller application 520-1 in processor 113 as the audio effects controller process 520-2. Those skilled in the art will understand that the source device 120 can include other processes and/or software and hardware components, such as an operating system that controls allocation and use of hardware resources associated with the source device 120. Also, note that some or all of the embodiments herein can be implemented using hardware alone, or software alone, and/or a combination of hardware and software Embodiments herein are well suited for use in applications such as those that support application of different audio effects to a received audio signal. However, it should be noted that configurations herein are not limited to such use and thus configurations herein and deviations thereof are well suited for use in other environments as well.

What is claimed is:

1. A method comprising:

receiving an audio signal;

monitoring motion associated with a motion sensor device affixed to a hand of a user generating the audio signal;

for detected motion of the motion sensor device within a range, applying audio effects to the received audio signal depending on a magnitude of the detected motion; and applying filtering and amplification to a respective signal generated by the motion sensor device to enable the user to play a musical instrument with the hand based on a first type of motion associated with the hand as well as control the audio effects applied to the audio signal with a second type of motion associated with the hand.

2. A method as in claim 1 further comprising:

monitoring the respective generated by the motion sensor device, the respective signal indicative of movement of the motion sensor device affixed to the hand;

detecting, based on the respective signal indicative of movement of the motion sensor device affixed to the hand, occurrence of a change in the movement of the motion sensor device outside of the range; and in response to detecting the change in movement of the motion sensor device outside of the range, disabling application of the audio effects to the received audio signal.

3. A method as in claim 2, wherein monitoring the motion associated with the motion sensor device includes monitoring acceleration associated with the hand based on the respective signal generated by the motion sensor device.

4. A method as in claim 1 further comprising:

detecting a change in motion associated with the motion sensor device;

comparing the change in motion to a threshold value; and in response to detecting that the change in motion for a given time interval is greater than a threshold value, discontinuing application of the audio effects to the received audio signal.

5. A method as in claim 1, wherein monitoring motion associated with the motion sensor device includes monitoring a magnitude of a motion parameter associated with the motion sensor device, the method further comprising:

in response to detecting that a change in the magnitude of the motion parameter is greater than a threshold value, discontinuing application of the audio effects to the received audio signal.

6. A method as in claim 5, wherein the motion parameter is deceleration of the motion sensor device.

7. A method as in claim 5, wherein detecting that the change in the magnitude of the motion parameter is greater than the threshold value includes detecting that a user wearing the motion sensor device knocks on an object to disable application of the audio effect to the received audio signal.

8. A method as in claim 1, wherein monitoring the motion associated with the motion sensor device includes:

monitoring motion associated with the hand, the hand generating the audio signal by playing a respective musical instrument.

9. A method as in claim 1, wherein applying audio effects to the received audio signal includes applying a first audio effects function to the received audio signal based on a magnitude of a monitored motion parameter associated with the motion sensor device, the method further comprising:

in response to detecting occurrence of the monitored motion parameter above a threshold value, terminating application of the first audio effects function to the audio signal and applying a second audio effects function to the received audio signal.

10. A method as in claim 1, wherein applying the audio effect to the received audio signal includes at least one of: amplification, attenuation, distortion, reverberation, time delaying, up mixing, down mixing of the received audio signal into other frequency bands for purposes of modifying the received audio signal.

11. A method as in claim 1, wherein the motion sensor device is affixed to a back of the hand.

12. A method as in claim 1, wherein the motion sensor device is affixed to a finger on the hand.

13. A method as in claim 11, wherein the user generates the audio signal based on playing the musical instrument via motion associated with the hand.

14. A method as in claim 12, wherein the user generates the audio signal based on playing the musical instrument via motion associated with the hand.

15. A method as in claim 1, wherein the motion sensor device resides in a guitar pick used by the user to play a guitar that generates the audible signal.

16. A method as in claim 1, wherein applying the audio effects includes:

utilizing the magnitude of the detected motion to provide continuous and varied control of the audio effects over each of multiple different magnitudes of motion sweeping through the range.

17. A method as in claim 1, wherein monitoring the motion associated with the motion sensor device includes:

monitoring motion of the hand based on receipt of the respective signal generated by the motion sensor device affixed to the hand, the respective signal varying in magnitude depending on a magnitude of the motion of the hand, the hand generating the audio signal by playing the respective musical instrument.

18. A method as in claim 17 further comprising:

applying filtering to the respective signal generated by the motion sensor device enabling the user to:

play the musical instrument with the hand based on a first type of motion associated with the hand, and control the audio effects applied to the audio signal with a second type of motion associated with the hand.

19. A method comprising:

receiving an audio signal;

monitoring motion associated with a motion sensor device; and for detected motion of the motion sensor device within a range, applying audio effects to the received audio signal depending on a magnitude of the detected motion; and detecting that a user wearing the motion sensor device knocks on an object to switch between a first mode of applying the audio effect to the received audio signal and a second mode of terminating application of the audio effect to the received audio signal.

20. A computer program product including a computer-readable storage medium having instructions stored thereon for processing data information, such that the instructions, when carried out by a processing device, enable the processing device to perform the operations of:

receiving an audio signal;

monitoring motion associated with a motion sensor device affixed to a hand of a user generating the audio signal;

for detected motion of the motion sensor device within a range, applying audio effects to the audio signal depending on a magnitude of the detected motion; and applying filtering and amplification to a respective signal generated by the motion sensor device to enable the user to play a musical instrument with the hand based on a first type of motion associated with the hand as well as control the audio effects applied to the audio signal with a second type of motion associated with the hand.

21. A computer program product as in claim 20 further supporting operations of:

detecting occurrence of a change in movement of the motion sensor device outside of the range; and in response to detecting the change in movement of the motion sensor device outside of the range, disabling application of the audio effects to the audio signal.

22. A computer program product as in claim 21, wherein monitoring the motion associated with the motion sensor device includes monitoring acceleration associated with the motion sensor device.

23. A computer program product as in claim 20 further supporting operations of:

detecting a change in motion associated with the motion sensor device;

comparing the change in motion to a threshold value; and in response to detecting that the change in motion for a given time interval is greater than a threshold value, discontinuing application of the audio effects to the audio signal.

24. A computer program product as in claim 20, wherein monitoring motion associated with the motion sensor device includes monitoring a magnitude of a motion parameter associated with the motion sensor device, the computer program product further supporting operations of:

in response to detecting that a change in the magnitude of the motion parameter is greater than a threshold value, discontinuing application of the audio effects to the audio signal.

25. A computer program product as in claim 24, wherein the motion parameter is deceleration of the motion sensor device; and wherein detecting that the change in the magnitude of the motion parameter is greater than the threshold value includes detecting that a user wearing the motion sensor device knocks on an object to disable application of the audio effect to the audio signal.

26. A computer program product as in claim 25, wherein detecting that the change in the magnitude of the motion parameter is greater than the threshold value includes detecting that the user wearing the motion sensor device knocks on the object to enable application of the audio effect to the audio signal.

27. A computer program product as in claim 20, wherein applying the audio effect to the audio signal includes at least one of: amplification, attenuation, distortion, reverberation, time delaying, up mixing, down mixing of the audio signal into other frequency bands for purposes of modifying the audio signal.

28. A computer system comprising:

a processor;

a memory unit that stores instructions associated with an application executed by the processor; and an interconnect coupling the processor and the memory unit, enabling the computer system to execute the application and perform operations of:

receiving an audio signal;

monitoring motion associated with a motion sensor device affixed to a hand of a user generating the audio signal; and for detected motion of the motion sensor device within a range, applying audio effects to the received audio signal depending on a magnitude of the detected motion; and applying filtering and amplification to a respective signal generated by the motion sensor device to enable the user to play a musical instrument with the hand based on a first type of motion associated with the hand as well as control the audio effects applied to the audio signal with a second type of motion associated with the hand.

* * * * *